US010752028B2

(12) United States Patent
Donaldson et al.

(10) Patent No.: US 10,752,028 B2
(45) Date of Patent: Aug. 25, 2020

(54) DUAL ENCODER SYSTEM TO MINIMIZE REFLEX PRINTING VARIATION

(71) Applicant: Xerox Corporation, Norwalk, CT (US)

(72) Inventors: Patricia J. Donaldson, Pittsford, NY (US); James P. Calamita, Spencerport, NY (US); David M. Kerxhalli, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 2 days.

(21) Appl. No.: 16/204,326

(22) Filed: Nov. 29, 2018

(65) Prior Publication Data

US 2020/0171855 A1 Jun. 4, 2020

(51) Int. Cl.

| | |
|---|---|
| ***B41J 11/42*** | (2006.01) |
| ***B41J 2/155*** | (2006.01) |
| ***B41J 15/16*** | (2006.01) |
| ***B41J 25/00*** | (2006.01) |
| ***B41J 15/04*** | (2006.01) |
| ***B41J 2/21*** | (2006.01) |

(52) U.S. Cl.

CPC ..... *B41J 11/42* (2013.01); *B41J 2/155* (2013.01); *B41J 2/2146* (2013.01); *B41J 15/04* (2013.01); *B41J 15/16* (2013.01); *B41J 25/001* (2013.01)

(58) Field of Classification Search

CPC ... B41J 11/42; B41J 15/04; B41J 15/16; B41J 2/2146; B41J 2/155; B41J 25/001

See application file for complete search history.

(56) References Cited

U.S. PATENT DOCUMENTS

| | | | | |
|---|---|---|---|---|
| 8,453,828 | B2 * | 6/2013 | Satoh | B41J 11/42 198/783 |
| 2012/0113176 | A1 | 5/2012 | Folkins et al. | |
| 2012/0268514 | A1 * | 10/2012 | Viturro | B41J 11/42 347/14 |
| 2014/0023421 | A1 | 1/2014 | Leighton et al. | |
| 2016/0279978 | A1 * | 9/2016 | Stephens | B41J 3/60 |
| 2019/0263153 | A1 * | 8/2019 | Wakabayashi | B41J 11/008 |

* cited by examiner

*Primary Examiner* — Bradley W Thies

(74) *Attorney, Agent, or Firm* — Maginot Moore & Beck LLP

(57) ABSTRACT

A printing system includes a pair of encoders to compensate for encoder noise in the velocity of a media transport as the transport moves past a plurality of printheads. One encoder monitors a roller that positioned at a location of low thermal stress and the signal generated by this encoder is used by a controller to maintain a constant velocity for the media transport. The second encoder monitors a roller used to drive the media transport and is positioned close to the print zone opposite the printheads. The signal from the second encoder is used to identify a corrected distance between each tic in the tics generated by the second encoder and the corrected distance is used to count a firing distance for generation of a dot clock signal to activate ejectors in a printhead when a substrate has traveled the firing distance.

19 Claims, 6 Drawing Sheets

DUAL ENCODER SYSTEM TO MINIMIZE REFLEX PRINTING VARIATION

CROSS REFERENCE TO RELATED PATENTS AND APPLICATIONS

U.S. Pat. No. 9,409,389, by Donaldson et al., issued Aug. 9, 2016 and entitled "COORDINATION OF PRINTHEADS/SUBSTRATE POSITION WITH TRANSFER OF MARKING MATERIAL" is incorporated herein by reference in its entirety.

TECHNICAL FIELD

Systems and methods described below generally relate to printing devices, and more particularly, to the accurate synchronization of the firing of ejectors in a printhead with the position of substrates opposite the printhead to enable the transfer of marking material from the printhead to the substrate.

BACKGROUND

In printing devices, accurate registration of marking material drops on passing substrates in the process direction is difficult. This registration is necessary to ensure that the drops from separated heads are printed at the required locations, especially for three-dimensional (3D) printing. Printheads, such as inkjet printheads, fire the appropriate ejectors with reference to a distance signal as print media, a plate, or platform passes the printheads to produce printed media, form 3-D items, or the like. The signal used to coordinate the firing of the ejectors in printheads is generated by an encoder monitoring a roller in the media transport. Unfortunately, the encoder feedback is subject to noise sources including phase-lag between the encoder roller and the print zone where the printheads are located, roller runout, thermal expansion of the encoder roller, and differential thermal expansion of the encoder roller coating. Feed-forward corrections based on measurements taken at a single point in time have been used to compensate for roller runout and thermal expansion. These corrections, however, cannot fully compensate for all of the noise sources. A more robust system of compensating for velocity changes in the print zone would be beneficial.

INCORPORATION BY REFERENCE

U.S. Pat. No. 9,844,961, by Mantell et al., issued Dec. 19, 2017 and entitled "SYSTEM AND METHOD FOR ANALYSIS OF LOW-CONTRAST INK TEST PATTERNS IN INKJET PRINTERS";

U.S. Pat. No. 9,278,531, by LeFevre et al., issued Mar. 8, 2016 and entitled "PRINT HEAD PROTECTION DEVICE FOR INKJET PRINTERS";

U.S. Pat. No. 9,022,500, by Leighton et al., issued May 5, 2015 and entitled "SYSTEM AND METHOD FOR ADJUSTING THE REGISTRATION OF AN IMAGE APPLIED TO RECORDING MEDIA IN A PRINTING SYSTEM";

U.S. Pat. No. 8,967,789, by Mandel et al., issued Mar. 3, 2015 and entitled "SPREADER/TRANSFIX SYSTEM FOR HANDLING TABBED MEDIA SHEETS DURING DUPLEX PRINTING IN AN INKJET PRINTER";

U.S. Pat. No. 8,888,225, by Donaldson et al., issued Nov. 18, 2014 and entitled "METHOD FOR CALIBRATING OPTICAL DETECTOR OPERATION WITH MARKS FORMED ON A MOVING IMAGE RECEIVING SURFACE IN A PRINTER";

U.S. Pat. No. 8,870,331, by Mo et al., issued Oct. 28, 2014 and entitled "SYSTEM AND METHOD FOR PROCESS DIRECTION ALIGNMENT OF FIRST AND SECOND SIDE PRINTED IMAGES";

U.S. Pat. No. 8,833,927, by Leighton et al., issued Sep. 16, 2014 and entitled "PRINTER HAVING SKEWED TRANSFIX ROLLER TO REDUCE TORQUE DISTURBANCES";

U.S. Pat. No. 8,814,300, by Shin et al., issued Aug. 26, 2014 and entitled "SYSTEM AND METHOD FOR SUBPIXEL INK DROP ADJUSTMENT FOR PROCESS DIRECTION REGISTRATION";

U.S. Pat. No. 8,567,894, by Viturro et al., issued Oct. 29, 2013 and entitled "REFLEX PRINTING WITH TEMPERATURE FEEDBACK CONTROL";

U.S. Pat. No. 8,491,081, by Leighton et al., issued Jul. 23, 2013 and entitled "SYSTEM AND METHOD FOR COMPENSATING FOR ROLL ECCENTRICITY IN A PRINTER";

U.S. Pat. No. 8,346,503, by Eun et al., issued Jan. 1, 2013 and entitled "SYSTEM AND METHOD FOR EQUALIZING MULTIPLE MOVING WEB VELOCITY MEASUREMENTS IN A DOUBLE REFLEX PRINTING REGISTRATION SYSTEM";

U.S. Pat. No. 8,328,315, by Eun et al., issued Dec. 11, 2012 and entitled "SYSTEM AND METHOD FOR SWITCHING REGISTRATION CONTROL MODES IN A CONTINUOUS FEED PRINTER";

U.S. Pat. No. 8,303,071, by Eun, issued Nov. 6, 2012 and entitled "SYSTEM AND METHOD FOR CONTROLLING REGISTRATION IN A CONTINUOUS FEED TANDEM PRINTER";

U.S. Pat. No. 8,251,504, by Viturro et al., issued Aug. 28, 2012 and entitled "REFLEX PRINTING WITH TEMPERATURE FEEDBACK CONTROL";

U.S. Pat. No. 8,162,428, by Eun et al., issued Apr. 24, 2012 and entitled "SYSTEM AND METHOD FOR COMPENSATING RUNOUT ERRORS IN A MOVING WEB PRINTING SYSTEM", and U.S. patent application Ser. No. 16/113,572 by Donaldson et al., filed Aug. 27, 2018, and entitled "METHOD, APPARATUS, DEVICE AND SYSTEM FOR CORRECTION OF ENCODER RUNOUT" are incorporated herein by reference in their entirety.

SUMMARY

A dual encoder feedback system enables a printer to coordinate more accurately the generation of the signals used for operating the ejectors in printheads with the position of the substrates opposite the printheads. The printer with the dual encoder feedback system includes a plurality of printheads configured to emit discrete units of marking material, a media transport configured to move media through the printing apparatus past the plurality of printheads to receive the discrete units of marking material, a first roller configured to follow the movement of the media transport, a second roller configured to drive the movement of the media transport, an actuator operatively connected to the second roller and configured to rotate the second roller to drive the movement of the media transport, a first encoder operatively connected to the first roller and configured to generate a series of tics that identify an index position on the first roller and an angular displacement on the first roller past the index position, a second encoder operatively connected to the second roller and configured to generate a series of tics that identify an index position on the second roller and an angular displacement on the second roller past the index position, a clock configured to generate a periodic signal at a predetermined frequency, a dot clock signal generator operatively connected to one of the printheads in the plurality of printheads and configured to generate a dot clock signal to operate ejectors in the printhead to which the dot clock signal generator is operatively connected, and a controller operatively connected to the first encoder, the second encoder, and the clock. The controller is configured to receive the tics from the first encoder and operate the actuator to maintain the movement of the media transport at a predetermined constant velocity, generate a number of tics corresponding to a distance between a location on a substrate moving in a process direction toward the plurality of printheads and the printhead to which the dot clock signal generator is operatively connected, the generated number of tics having a discrete number of tics and a fractional number of tics, count the tics generated by the second encoder until the counted number of tics equals the discrete number of tics in the generated number of tics, count transitions in the periodic signal from the clock until a number of counted transitions equals the fractional number of tics, and operating the dot clock signal generator to generate the signal that activates the ejectors in the printhead operatively connected to the dot clock signal generator when the number of counted transitions equals the fractional number of tics.

A method of printer operation enables a printer to coordinate more accurately the generation of the signals used for operating the ejectors in printheads with the position of the substrates opposite the printheads. The method includes receiving with a controller tics that are generated by a first encoder operatively connected to a first roller of a media transport, the tics identifying an index position on the first roller and an angular displacement on the first roller past the index position, operating an actuator operatively connected to a second roller of the media transport to maintain movement of the media transport at a predetermined constant velocity, generating with the controller a number of tics corresponding to a distance between a location on a substrate moving in a process direction toward a plurality of printheads and a printhead to which a dot clock signal generator is operatively connected, the generated number of tics having a discrete number of tics and a fractional number of tics, counting with the controller tics that are generated by a second encoder operatively connected to the second roller until the counted number of tics generated by the second encoder equals the discrete number of tics in the generated number of tics, the tics generated by the second encoder identifying an index position on the second roller and an angular displacement on the second roller past the index position, counting with the controller transitions in a periodic signal from a clock until a number of counted transitions equals the fractional number of the generated tics, and operating the dot clock signal generator to generate a dot clock signal that activates ejectors in the printhead operatively connected to the dot clock signal generator when the number of counted transitions equals the fractional number of the generated tics.

BRIEF DESCRIPTION OF THE DRAWINGS

The foregoing aspects and other features of a dual encoder feedback system that enables generation of the signals used for operating the ejectors in printheads with the position of the substrates opposite the printheads are explained in the following description, taken in connection with the accompanying drawings.

DETAILED DESCRIPTION

Figure 1:
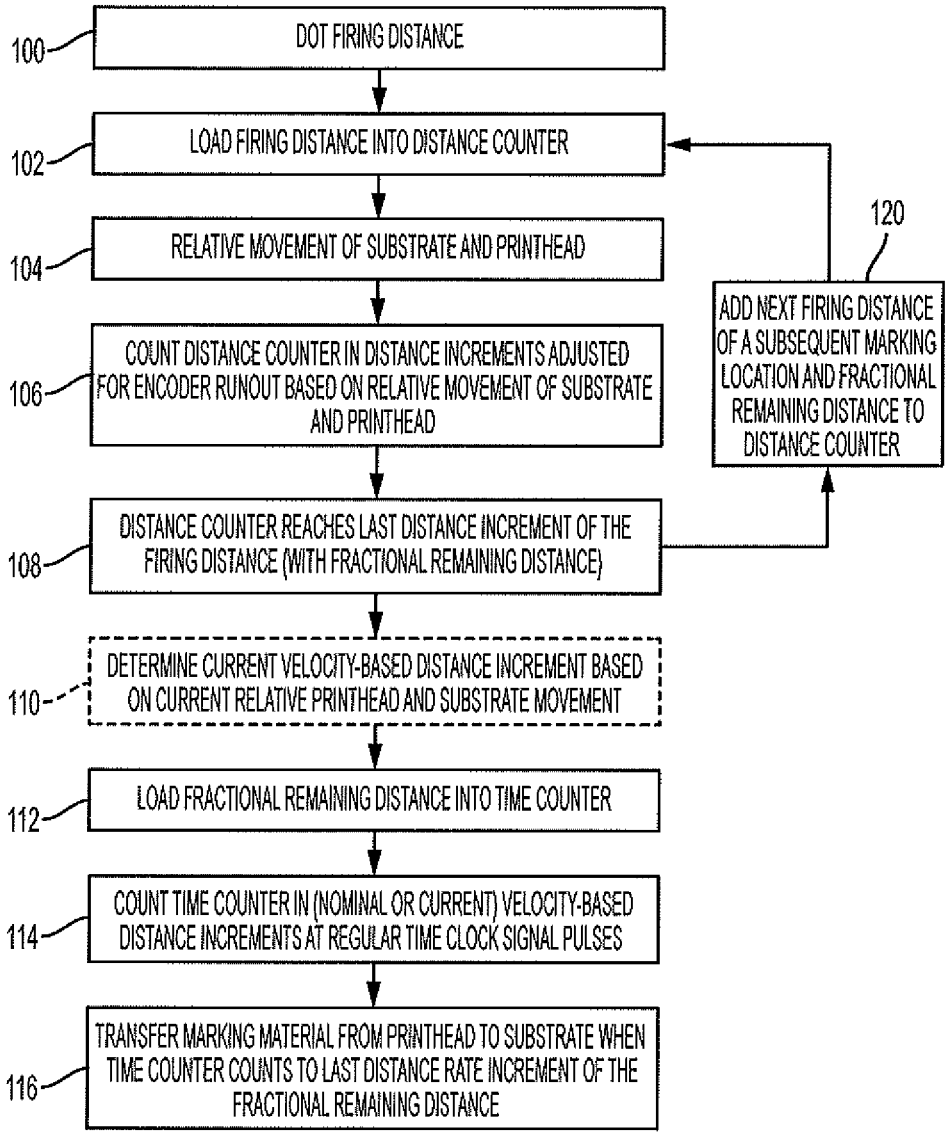
FIG. 1 is a flow chart of a method for correction of encoder noise associated with a printing system according to an exemplary embodiment of this disclosure.

Various methods, devices, and systems described below use a first encoder to maintain an average constant velocity of a media transport in a printer and a second encoder to identify and compensate for high frequency velocity variation in the generation of dot clock signals used to operate ejectors in printheads. The signal from the first encoder is delivered to a controller that regulates the motor driving the media transport. This signal is used by the controller to identify the average velocity of the media transport and to adjust the speed of the driving motor to maintain an average constant velocity of the media transport. The dot clock signals are generated with reference to a dot clock "firing distance," which is loaded into a distance counter. The firing distance is the distance from the current position of a printhead to a marking location on a substrate and can be supplied from a previously determined parameter, such as a bitmap, dot spacing requirement, or the like, or it can be calculated in real time. In the dual encoder system described below, the second encoder is associated with a roller used to drive the media transport and that experiences the high frequency velocity variation to which the encoder is subjected in the print zone. The firing distance is loaded into a distance counter that is operatively connected to the second encoder that monitors the roller driven by the motor of the media transport. The distance counter counts down the firing distance in discrete distance increments that are corrected for dynamic encoder noise. The distance count is based on "tics" generated by the second encoder. As used in this document, the term "tic" refers to a signal generated by an encoder that indicates a physical component has rotated by a predetermined angle. When the distance counter reaches the last discrete distance increment of the firing distance, a fractional remaining distance of the firing distance is loaded into a time counter, which counts down the remaining distance with reference to a signal generated by a clock. The fractional remaining distance is a distance less than one of the discrete distance increments corrected for encoder noise and counted by the distance counter.

The fractional remaining distance is generated using velocity-based calculated distance increments at regular time intervals using the time counter. The regular time intervals correspond to time signals received from a time clock of the printing device. The distance value of each velocity-based distance increment is calculated, based on the current relative velocity between the printhead and the substrate, and the time signal rate output by the time clock; or a previously calculated nominal velocity-based distance increment can be used. When the time counter reaches the last velocity-based distance increment of the fractional remaining distance, the signal used to operate the ejectors in a printhead to eject marking material from the printhead to the substrate is generated.

The methods, devices, and systems can optionally add the next firing distance of a subsequent marking location to the fractional remaining distance, when the fractional remaining distance is transferred to the time counter, and load the sum to the distance counter before repeating the processes of counting the firing distance, loading the fractional remaining distance, counting the fractional remaining distance, and transferring the marking material for the subsequent marking location.

Printing systems and devices described in this document include, among other components, any form of printhead, a processor operatively connected, either directly or indirectly, to the printhead, a substrate support operatively connected to the processor, or the like. The substrate support can include rollers, a plate, a platform, or the like, which supports a substrate adjacent to the printhead. The printhead transfers marking material in discrete units, variously called dots, drops, droplets, pixels, or the like, toward or onto the substrate, such as a cut-sheet.

The printing systems and devices discussed below include a primary encoder, which generates a signal used to maintain an average constant velocity of the media transport, and a secondary encoder, which measures variations in the motion of the media transport. These motion variation measurements are used to generate a time clock that operates the printheads in the printer to compensate for these motion variations. The signal from the primary encoder is used by the drive system of the media transport to maintain an average constant velocity of the media transport. The roller monitored by this encoder is either positioned at a location that is not subject to the thermal stresses encountered near and in the print zone opposite the print heads, such as a temperature in the range of about 20° C. to about 30° C., or the roller has a low thermal coefficient of expansion. This roller is manufactured with a low runout, such as about 1 micron to about 20 microns. The belt or web contacting the roller has a degree of wrap that is sufficient to prevent slippage of the belt or web on the roller with reference to the coefficient of friction between the roller and the belt. Generally, the wrap angle is greater than 4 degrees, typically in a range of about 25 degrees to about 80 degrees, and the friction coefficient is between about 0.2 to about 0.8. In one embodiment, the reflex roller of the media transport has a diameter of 42.486 mm, a maximum runout of 13 microns, a wrap angle of 65 degrees, and a thermal coefficient of linear expansion of about 22 microns/K°, although a thermal coefficient of linear expansion in the range about 20 microns/K° to about 25 microns/K° is satisfactory. The roller monitored by the secondary encoder is used by the reflex printing system to fire the print heads after the web has moved the specified firing distance. This encoder needs to monitor a roller that is close to the print zone so the roller accurately reflects the motion variations occurring in the print zone up to the highest frequencies that are to be corrected. The signal from this encoder is counted by the distance counter in discrete distance increments as the substrate moves relative to the printhead and this signal can also be used to correct the fractional count that is counted with reference to the signal from the time clock.

As discussed above, printheads fire when they receive a dot clock signal. Various techniques are used to generate dot clock signals. Some dot clock signal generators produce the dot clock signal by counting an encoder signal directly. This technique yields a single firing resolution, usually denoted in dots-per-inch, but ties the ejector firing directly to an absolute location indicated by the encoder signal so no drift is detected. Other methods calculate the velocity of the substrate at intervals and then the dot clock signals are integrated to provide the velocity over time.

The devices and methods described below use a hybrid approach that retains the advantages of variable dot spacing while eliminating drift. The devices and methods described below combine a primary distance "clock" that decrements a count, not with reference to time units, but with reference to the secondary encoder tics, which correspond to the movement or rotation of a physical item moving in the printer. A time clock, which is started when the primary distance clock is within a single encoder tic of the desired dot clock firing position, decrements the remaining distance with reference to a time signal to correct for the drive roller encoder noise.

In some cases, the distance the substrate travels between encoder tics may not be the same at different temperatures of the roller. This deviation is particularly true for rollers coated with a slip resistant surface, which may expand or contract at different temperatures. In these cases, the distance the substrate moves between encoder tics may depend on the temperature of the roller. The encoder sends out an index pulse when the encoder is at one absolute location for a linear encoder or at a particular angle of rotation for a rotary encoder. The roller position can be determined by counting tics past the index.

In order to track these differences in distance, the devices and methods discussed below determine the distance increment for secondary encoder tics as a function of encoder position. The devices and methods discussed below apply the correction or apply the provided encoder tic distance data to the distance increment used by the distance counter. Further, with devices and methods described below, according to an exemplary embodiment, the distance increment can also be compensated by making the time clock distance a function of the encoder position and temperature.

The hybrid approach disclosed below includes corrections for roller expansion and contraction, maximizes dot clock spacing accuracy, allows for variable dot spacing, and also ensures accurate location, without drift, over the entire print zone. Therefore, with the devices and methods described below, any errors in velocity are only integrated over a single encoder tic interval, which gives absolute position errors that are significantly less than a micron, and which do not accumulate over time.

As discussed above, the exemplary embodiments discussed below generates an encoder angular distance correction function, which is used to calculate the angular distance between tics as a function of the encoder angular position, that is, tics past an encoder index. To generate this correction function, the measured time, which in one embodiment is measured by the number of 100 MHz clock counts between encoder tics, is used to measure the change in distance between tics over time, by assuming that the velocity of the roller is equal to the nominal velocity. While the time between tics is a strong function of the velocity, averaging over many roller revolutions allows the correction function to be calculated accurately. This technique of determining changes in the encoder roller is especially useful in cut-sheet printing systems where long printed test patterns cannot be used. The disclosed correction can be achieved by simply running the encoder and counting the tics. According to an exemplary embodiment, Absolute Registration Code operatively associated with a control processor maintains a distance to the next dot clock, which is decremented by the encoder tic distance each time a tic is detected. The index-corrected distance per tic is used in place of the nominal distance per tic. U.S. Pat. No. 9,409,389, by Donaldson et al., issued Aug. 9, 2016 and entitled "Coordination of printheads/substrate position with transfer of marking material" provides additional details of the Absolute Registration Code.

The yRegistration FPGA (Field-Programmable Gate Array) code counts the number of yReg clocks between encoder tics. This information is transmitted to the yReg code at each interrupt along with the total number of encoder counts. The encoder index position is also recorded so that the number of counts past the index can be determined. YRegistration refers to position in the process direction through the print zone. The disclosed encoder correction process averages the clock counts per tic for some interval of time past the index. As a result, over many encoder revolutions a direct measure of the relative distance between tics around the encoder roll is obtained. The time between tics is converted to a distance between tics assuming that the velocity is known. A known velocity is achieved by using the output of an accurate primary encoder to control the substrate velocity. The measured distances between tics are used to generate a table of tic distance vs encoder position and the corrected distance per tic is downloaded to the FPGA at each interrupt and used by the Absolute yRegistration Code. The absolute yRegistration code maintains a distance to the next dot clock, which is decremented by the encoder tic distance each time a tic is detected. The index-corrected distance per tic is used in place of the nominal distance per tic.

Figure 2:
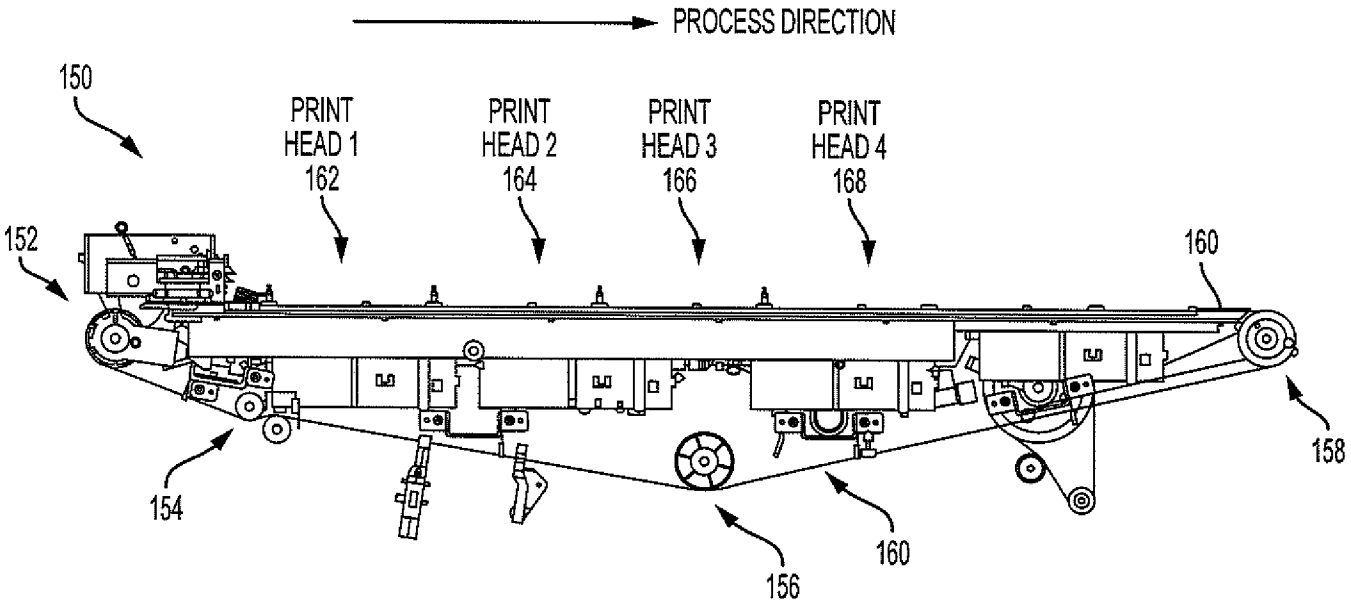
FIG. 2 is a diagram of a media transport and associated printhead marking stations that includes a pair of encoders according to an exemplary embodiment of this disclosure.

FIG. 1 is a flowchart illustrating an exemplary method herein that performs automated operations that do not require user input. FIG. 2 is a diagram of a media transport 150 including an encoder/encoder roller arrangement, the media transport 150 including a media cut-sheet transport belt 160, a steering mechanism 152, a reflex roller encoder 154, a belt tensioner roller 156, and a transport belt drive roller encoder 158 and printheads 162, 164, 166, and 168. Although the issues arising from expansion and contraction of encoder rollers can occur in printers using various types of marking materials, the issues can be particularly acute in some aqueous ink printers because these printers require high temperature dryers to remove a substantial amount of water from the ink on the media soon after it is ejected onto the media. For example, the media transport 150 of FIG. 2 can be incorporated in an aqueous inkjet printer opposite the printheads 162, 164, 166, and 168, which eject drops of aqueous ink. After the media leaves the transport 150 it passes through a high temperature dryer, which is in proximity to the driver roller monitored by the drive roller encoder 158. As this drive roller is typically coated with a slip resistant coating, it can be subjected to temperatures that expand and contract the coating. Hence, the need for the compensating schemes discussed below are particularly appropriate in such printers. An embodiment of the media transport 150 is also incorporated into the printer shown in FIG. 6 opposite the printheads 323.

Again, with reference to FIG. 2 and the incorporation of such a media transport in an aqueous inkjet printer, the roller monitored by the reflex encoder 154 is far enough from the dryer to the immediate right of the driver roller encoder 158 that it is relatively isolated from the high frequency velocity variations that occur between the roller monitored by the encoder 158 and the steering mechanism 152. Additionally, the roller at the reflex encoder 154 has no coating and it rotates freely with the transport belt so it measures low-frequency velocity accurately. That is, the roller at the reflex encoder has low runout and a small mass so the belt easily turns it. The driver roller, however, is coated with a non-slip coating to aid in driving the belt, but this coating swells in response to the heat from the dryer. The drive roller needs this coating because the transport belt is large and heavy and, if it was not coated, the roller might slip against the transport belt. A slip resistant coating can be, for example, rubber, polyurethane polyester, and polyether polyester. In one embodiment, the roller is coated with ethylene propylene diene monomer (EPDM) rubber. Because the drive roller at the encoder 158 pulls the transport belt through the print zone so it also responds effectively instantaneously to velocity variations in the print zone. By compensating for the variations in the encoder signal from the drive roller encoder 158 as explained more fully below, the dot clock signal generators can generate the firing signals for the printheads more accurately.

More specifically, as shown in FIG. 1, the method starts with a dot "firing distance" to an initial or the next dot that is to be printed (block 100). The firing distance is the distance from the current position of a printhead of the printing device to a marking location on a substrate and can be supplied from a previously determined item, such as a bitmap or dot spacing requirement; or can be calculated in real time. The method loads the firing distance into a distance counter, which is the counter monitoring the signal from the drive roller encoder 158. The marking location identifies the point at which the printhead transfers (e.g., ejects, releases, disperses, forces, directs, or the like) marking material in discrete units (e.g., dots, drops, droplets, pixels, or the like) toward, or onto the substrate. As understood by those ordinarily skilled in the art, a "dot of marking material" can comprise any portion (e.g., droplet, drop, pixel, or the like) of any type of marking material (e.g., liquid ink, solid ink, toner, magnetic ink, or the like); or any other base unit of marking material, whether currently known or developed in the future.

Relative movement between the substrate and printhead can be caused by moving either one or both using actuators, electromagnetic motors, hydraulic devices, pneumatic devices, gears, belts, rollers, or the like. All such physical devices can indicate movement through sensors by detecting current draw or the like. Therefore, as these physical devices move, they output periodic signals indicating that the substrate and printhead have moved a distance increment relative to one another, which is measured in any type of distance units. Further, these devices and methods compensate for the physical irregularities of any devices by making the distance amount of the distance increment a function of the encoder position.

The firing distance is counted in discrete distance increments using the distance counter and encoder distance data corrected for sources of error (block 106) based on the relative movement of the substrate and the printhead monitored by the processing in block 104 (e.g., based on "tics" corresponding to the rotating or moving of a physical component within the printing device), as well as the angular position of the encoder tic past the encoder tic index. During the firing distance counting performed by the processing in block 106, the distance counter reaches the last discrete distance increment of the firing distance (block 108). The last discrete distance increment is generally zero, but could be arbitrarily set at any number or level. Stated more specifically, the last discrete distance increment is the discrete distance increment that brings the firing distance to zero or to a positive number that is less than one discrete distance increment.

Unless the firing distance is completely divisible by the discrete distance increment, corrected for noise in the encoder angle from the drive roller encoder, a fractional portion of the firing distance remains in the distance counter after the distance counter counts to the last discrete distance increment. This fractional remaining distance is a distance less than the discrete encoder corrected distance increments counted by the distance counter. For example, if the firing distance is 10.25 distance units and the error corrected total distance associated with the next 10 tics is 10.1 distance units, the distance counter counts down 10 discrete distance increments, leaving 0.15 distance units as the fractional remaining distance.

Optionally, as shown by the dashed lines in FIG. 1 the distance is calculated using a velocity-based distance increment calculation, based on the current relative velocity between the printhead and the substrate and the time signal rate output by the time clock; and this calculation can be performed for each firing distance and for each mark that is printed. In other words, the count within the time counter occurs at a rate over time based upon how fast the printhead and substrate are moving relative to one another, and the processing of block 110 determines the relative velocity based upon that rate corrected for the encoder noise as a function of the encoder tic angular position.

Figure 7:
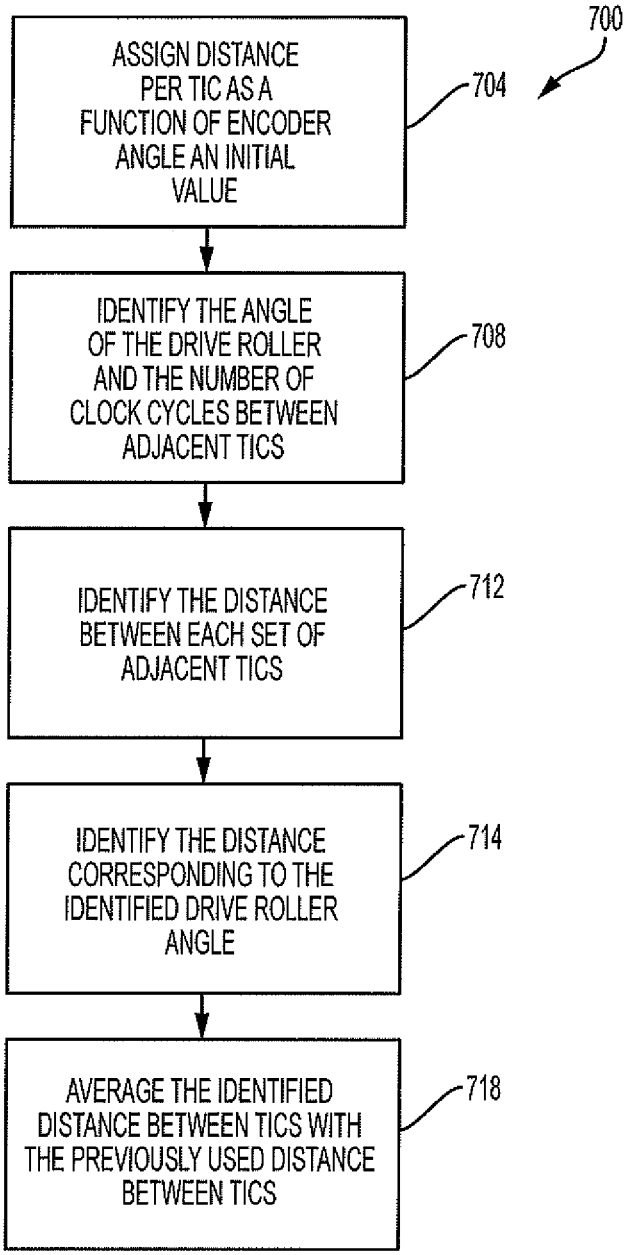
FIG. 7 is a flow diagram of a process for compensating for velocity variations in the print zone of the printer shown in FIG. 6.

To compensate for encoder noise in the distance per tic as a function of encoder angle, the processing of block 106 is performed with the process shown in FIG. 7. The process 700 begins by assigning an initial value of the distance per tic as a function of encoder angle (block 704). This initial value can be an empirically predetermined value or it can be identified by the processing in block 718 from a previous operation cycle of the roller. The angle of the roller monitored by the drive roller encoder is then identified and the number of clock cycles between adjacent tics within the identified angle is also identified (block 708). The angle of the roller is identified by the number of tics since the index tic was encountered and the number of clock cycles refers to the number of reference clock transitions between adjacent tics of the identified angle. The distance between each set of adjacent tics is identified (block 712). The distance between adjacent tics is determined by using the velocity of the transport belt identified by the reflex encoder and the time between adjacent tics. The distance between tics is used to identify the distance for the current encoder angle (block 714) and average the distance between tics with the previously used distance between tics for the encoder angle (block 718). This average distance is used for the next revolution of the roller.

With continued reference to FIG. 1, the velocity of the printhead/substrate movement is divided by the rate of time signals produced by the time clock (block 110) to arrive at the velocity-based calculated distance increment at which a time counter associated with the drive roller encoder 158 of the printing device increments. Alternatively, the processing of block 110 can be skipped and a nominal (previously calculated) velocity-based distance increment can be used which may or may not be calculated based on the encoder noise distance data. In either case, so long as the velocity of the printhead/substrate remains somewhat constant, during each clock pulse from the time clock used by the time counter, the distance between the printhead and the marking location changes by the same distance (e.g., the velocity-based distance) and each increment by the time counter represents this distance.

The fractional remaining distance of the firing distance is loaded into the time counter (block 112). Then, the fractional remaining distance is counted using the velocity-based calculated distance increments (block 114), which may or may not be error corrected for encoder noise, at regular time intervals, using the time counter. Again, the regular time intervals correspond to periodic, regular time signals received from a time clock of the printing device. When the time counter reaches the last velocity-based calculated distance increment of the fractional remaining distance (e.g., zero or the last positive number that is smaller than one velocity-based distance increment), the marking material is transferred from the printhead to the substrate to print a dot or mark on the substrate (block 116).

The next firing distance of a subsequent marking location is added to the fractional remaining distance from the processing performed in block 108 (block 120), and the sum of these distances is loaded into the distance counter (block 102) before repeating the processes of counting the firing distance, loading the fractional remaining distance, counting the fractional remaining distance, and transferring the marking material for the subsequent marking location. This processing is done at the time that the fractional distance is transferred to the time distance counter. Thus, if an additional drop is fired, the dot spacing is added to the fractional remaining distance in the distance counter at the same time, or potentially immediately after, the fractional remaining distance is transferred to the time counter.

For example, the firing distance identified in block 100 processing can be, in this example, 10.25 distance units of any distance measurement (dots per inch (DPI), tics, inches, millimeters, microns, or the like); and this distance may be limited by the resolution of the printing device, the desired dot spacing, or the like. The distance counter counts in "discrete" (meaning whole number) distance increments error corrected for encoder noise, and not fractions or portions of distance increments in the processing of block 106, and in this example, decrements or increments of one distance unit, are error corrected for encoder noise. Therefore, the fractional remaining distance for this example that is used in the processing of block 108 is 0.15 distance units.

In other words, the printhead should disburse the drop of marking material 15/100 of the way into the $10^{th}$ distance increment to properly meet a requirement of counting to 10.25 distance increments of the reflex roller encoder 154. Continuing with the same example, if the time counter begins counting down at a velocity-based calculated distance increment of 0.01 distance units from a starting count of 0.15 velocity-based distance increments to zero as performed by the processing of block 114, the time counter reaches the firing time increment after fifteen velocity-based distance calculated increments, at which point, the processing of block 116 generates the signal that operates the ejectors to disburse one or more dots of material from the printer to the substrate.

While the foregoing examples discuss that the distance counter and time counter can decrement from a higher value to a zero value, such examples are only used for convenience of illustration, and those ordinarily skilled in the art understand that the distance counter and time counter could decrement to a non-zero value, or could increment from a lower value, such as zero, to a higher value; or could decrement or increment from any value to a different value. For example, the distant counter and time counter could decrement from a value of 50 and stop at a value of 20, and similarly, the distance counter and time counter could increment from a value of 10 to a value of 20. Regardless of the type of counting performed by the distance counter and the time counter (up or down), when these counters reach a preset value (which could be zero or a different number) they perform the action described in the flowchart shown in FIG. 1 by causing a remainder value (which could be relative to a non-zero number where counting stops) to be loaded into a different counter, or causing a printhead to transfer marking material, or the like.

As previously discussed, triggering the print heads when the paper has moved exactly one scanline, which is typically 1/600th of an inch, is critically important. Print head firing is typically controlled using an encoder roller arrangement. However, changes in encoder diameter may cause errors in drop placement, which can show up as banding on the print caused by encoder noise.

Provided below are further details of methods, devices, and systems to generate encoder changes distance data, i.e., the distance between specific tics or angular positions of a roller monitored by an encoder, which is used to determine accurately a distance of travel of a substrate, such as a cut-sheet, continuous web sheet, or image transfer belt, as measured by encoder tic counts to trigger one or more printheads to mark the substrate. To calculate the encoder noise using a yRegistration log and applying it using the absolute yRegistration code, the following steps are performed:

A) The yReg FPGA receives signals from the drive roller encoder, which include the transitions on an A and B channel, which represent "light to dark" and "dark to light" transitions of the encoder signal, plus the index location. After each YRegInterrupt clock cycles, the FPGA passes the following information up to the yReg application:

The number of encoder tics detected since the marker was cycled up (encoderCountLog);

The number of indexes detected since the marker was cycled up (indexCountLog); and The number of clock cycles between the last nEncoderAvg encoder tics (clkSumPrevLog).

A sample from a log is shown below:

| interruptId | encoderCountLog | indexCountLog | clkSumPrevLog | Tics past the index |
|---|---|---|---|---|
| 35039 | 2001501 | 100 | 398824 | 19698 |
| 35040 | 2001602 | 100 | 398824 | 19799 |
| 35041 | 2001702 | 100 | 398824 | 19899 |
| 35042 | 2001803 | 101 | 398824 | 0 |
| 35043 | 2001904 | 101 | 398824 | 101 |
| 35044 | 2002005 | 101 | 396608 | 202 |
| 35045 | 2002106 | 101 | 396608 | 303 |
| 35046 | 2002207 | 101 | 396608 | 404 |
| 35047 | 2002307 | 101 | 396608 | 504 |
| 35048 | 2002408 | 101 | 396608 | 605 |
| 35049 | 2002509 | 101 | 396608 | 706 |
| 35050 | 2002609 | 101 | 396608 | 806 |
| 35051 | 2002710 | 101 | 396608 | 907 |
| 35052 | 2002810 | 101 | 396608 | 1007 |
| 35053 | 2002910 | 101 | 396608 | 1107 |
| 35054 | 2003010 | 101 | 397830 | 1207 |

B) From the logged information, the approximate number of encoder tics past the index is determined.

Figure 3:
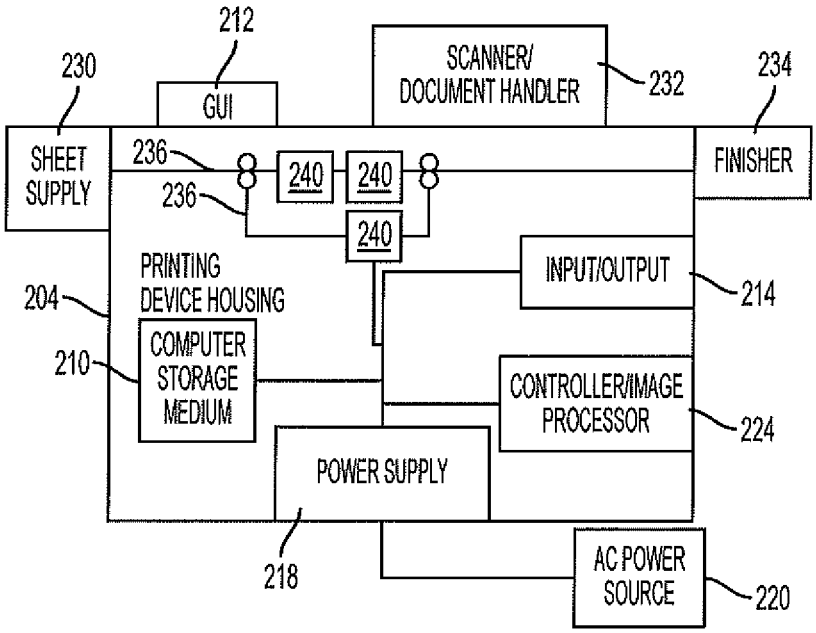
FIG. 3 is a block diagram of a printing apparatus according to an exemplary embodiment of this disclosure.

FIG. 3 illustrates an exemplary printing device 204, which can be used with systems and methods described in this document and can include, for example, a printer, copier, multi-function machine, multi-function device (MFD), or the like. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210, which can be optical, magnetic, capacitor based, or the like, and is different from a transitory signal, is readable by the tangible processor 224 and stores instructions that the tangible processor 224 executes to allow the computerized device to perform its various functions, such as those described in this document. Thus, as shown in FIG. 3, a body housing has one or more functional components that operate on power supplied from an alternating current (AC) source 220 by the power supply 218. The power supply 218 can comprise a common power conversion unit, power storage element, such as a battery, or the like.

The printing device 204 includes many of the components mentioned above and at least one marking device 240, such as a printing engine or engines operatively connected to a specialized image processor 224, which is different than a general purpose computer because it is specialized for processing image data, a media path 236 positioned to supply continuous media or sheets of media from a sheet supply 230 to the marking device(s) 240. After receiving various markings from the printing engine(s) 240, the sheets of media can optionally pass to a finisher 234 which can fold, staple, sort, or the like, the various printed sheets. Also, the printing device 204 can include at least one accessory functional component, such as a scanner/document handler 232, which can be an automatic document feeder (ADF), or the like, that also operates on the power supplied from the external power source 220 through the power supply 218.

The one or more printing engines 240 are intended to illustrate any marking device that applies a marking material, such as toner, inks, plastics, organic material, or the like, to continuous media or sheets of media, whether currently known or developed in the future and can include, for example, devices that use a photoreceptor belt or an intermediate transfer belt, devices that print directly to print media, such as inkjet printers, ribbon-based contact printers, 3D printers, or the like.

Figure 4:
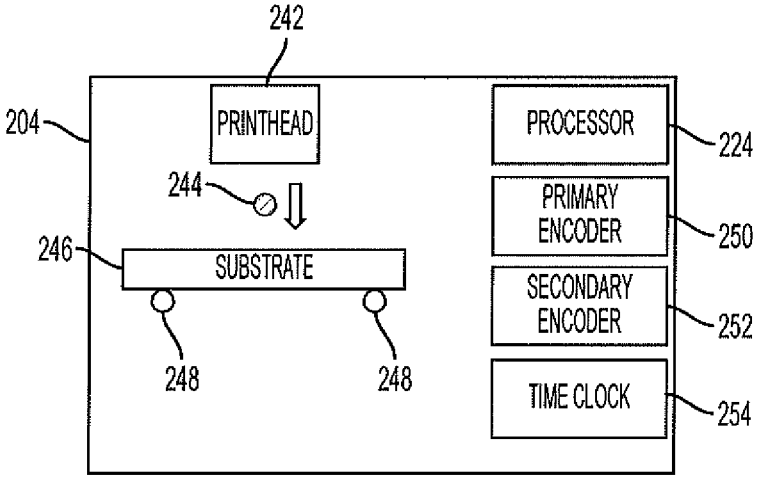
FIG. 4 is a block diagram of a media transport associated with a printing apparatus according to an exemplary embodiment of this disclosure.

As additionally shown in FIG. 4, the printing device 204 can include, among other components, any form of printhead 242, a processor 224 operatively connected to the printhead 242, a support 248 operatively connected to the processor 224, or the like. The support 248 can comprise rollers, a plate, a platform, and the like, that supports a substrate 246 adjacent to the printhead 242. The printhead 242 transfers material 244 in discrete units toward, or onto, the substrate 246. Further, such printing devices include a primary encoder 250 and a secondary encoder 252. The signal from the primary encoder 250 is used by the controller of the media transport to maintain an average constant velocity of the media transport and the signal from the secondary encoder 254 is used to operate the distance counter until the fractional count is transferred to the time counter, both counters are also operatively connected to the processor 224. The primary encoder 250 is the reflex encoder 154 in the media transport 150 shown in FIG. 2 and the secondary encoder is the drive roller encoder 158 of the same figure. The distance counter counts in discrete distance increments as the substrate 246 moves relative to the printhead 242 with reference to the signal from the secondary encoder. The time counter 252 counts at regular time intervals that correspond to time signals received from the time clock 254.

The processor 224 loads a firing distance into the distance counter that counts the tics generated by the secondary encoder 254. The firing distance is the distance from the current position of the printhead 242 to a marking location on the substrate 246. The distance counter counts the firing distance in the discrete distance increments corrected for encoder noise as discussed in this document based on relative movement of the substrate 246 and the printhead 242.

The processor 224 loads the fractional remaining distance of the firing distance into the time counter when the distance counter reaches the last discrete distance increment of the firing distance. The fractional remaining distance is a distance less than one of the discrete distance increments. The time counter counts the fractional remaining distance in the velocity-based distance increments at the regular time intervals. The processor 224 can determine the velocity-based distance increments based on the current relative velocity between the printhead 242 and the substrate 246. The printhead 242 transfers the marking material to the substrate 246 when the time counter 252 reaches the last velocity-based distance increment of the fractional remaining distance.

At the time that the fractional remaining distance is transferred to the time counter, the processor 224 can optionally add the next firing distance of a subsequent marking location and the fractional remaining distance together and supply this sum to the distance counter, when the printing apparatus repeats the processes of counting the firing distance, loading the fractional remaining distance, counting the fractional remaining distance, and transferring the marking material for the subsequent marking location.

Figure 6:
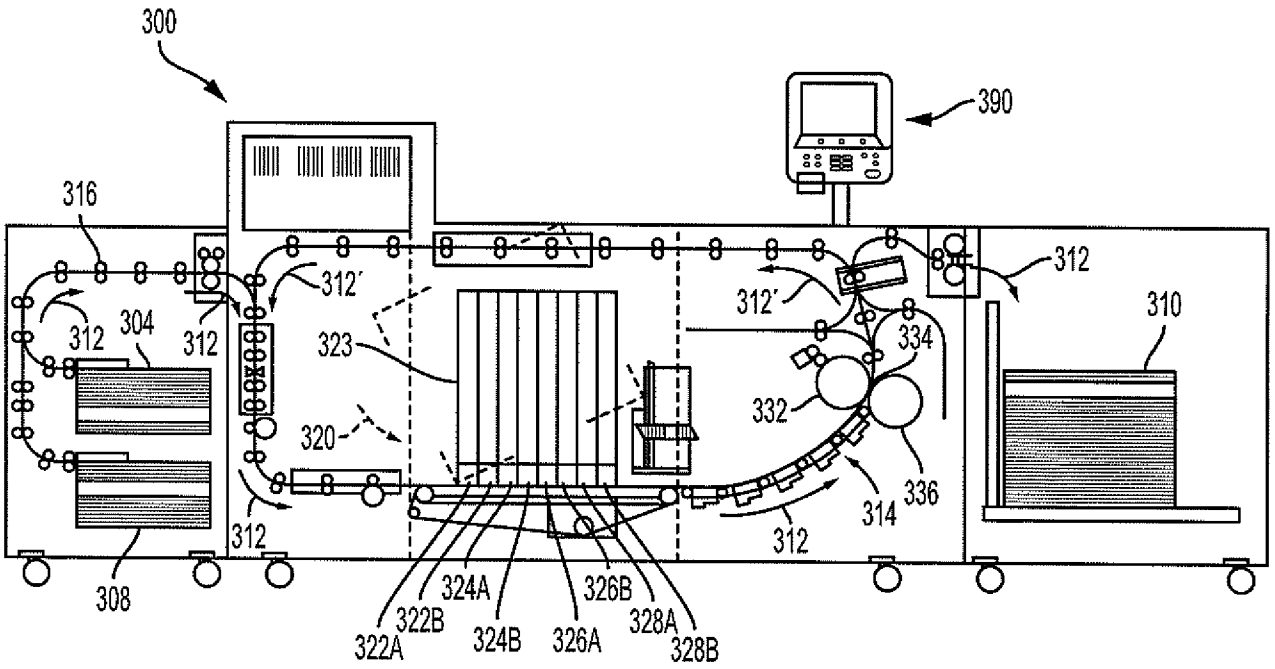
FIG. 6 is a diagram of a printing system including a dual encoder arrangement associated with media transport rollers according to an exemplary embodiment of this disclosure.

FIG. 6 depicts an exemplary direct inkjet printer 300 that includes media supplies 304 and 308, a media path 312, a print zone 320, a media sheet conveyor 314, a spreader roller 332, a pressure roller 336, a media output tray 310, and a controller 390. The media supplies 304 and 308 are each configured to hold a plurality of media sheets and supply the media sheets to the printer via the media path 312 for printing. In the embodiment of printer 300, the media supplies 304 and 308 can hold media sheets of different sizes. In alternative configurations, either or both media supplies 304 and 308 hold media sheets having A4 size (210 mm×297 mm), legal size (216 mm×356 mm), tabloid size (279 mm×432 mm), letter, legal, A4, or tabloid size tabbed media sheets, or various other sheet sizes. Other embodiments can include more than two media supplies to enable the printer to store and print a variety of media sizes and types. Various printer embodiments move the media sheets in either a length or width orientation during printing. Thus, the "length" of a media sheet in the process direction can be either of the length or width dimensions commonly used to describe a media sheet size. For example, the length of a letter size media sheet in the process direction can be either 215.9 mm or 279.4 mm depending on the orientation of the media sheet as a media transport moves the media sheet in a process direction through the printer.

During a print job, media sheets from one or both of the media supplies 304 and 308 move along the media path 312. The media path 312 is a media transport that includes a plurality of guide rollers, such as guide rollers 316, which engage each media sheet and move the media sheets through the printer 300. In FIG. 6, the media path 312 guides each media sheet past a print zone 320 in a process direction for imaging operations on a first side of each media sheet. A portion of the media path 312' reverses an orientation of the media sheets and directs the media sheets through the print zone 320 a second time in the process direction to enable the print zone 320 to print ink images during imaging operations on the second side of each media sheet. As described in more detail below, a portion of the media path 312 between the print zone 320 and the rollers 332 and 336 includes a series of variable speed conveyors 314.

The print zone 320 includes a plurality of printheads arranged in a cross-process direction across a width of each media sheet. In FIG. 6, the print zone 320 includes a total of eight marking stations configured to print color images using a combination of cyan, magenta, yellow, and black (CMYK) inks. In the print zone 320, marking stations 322A and 322B print magenta ink, marking stations 324A and 324B print cyan ink, marking stations 326A and 326B print yellow ink, and marking stations 328A and 328B print black ink. Various alternative configurations print with a single color of ink, or include different ink colors including spot colors. Each of the marking stations 322A-328B includes a plurality of printheads, each one of which includes a plurality of ejectors.

Figure 5:
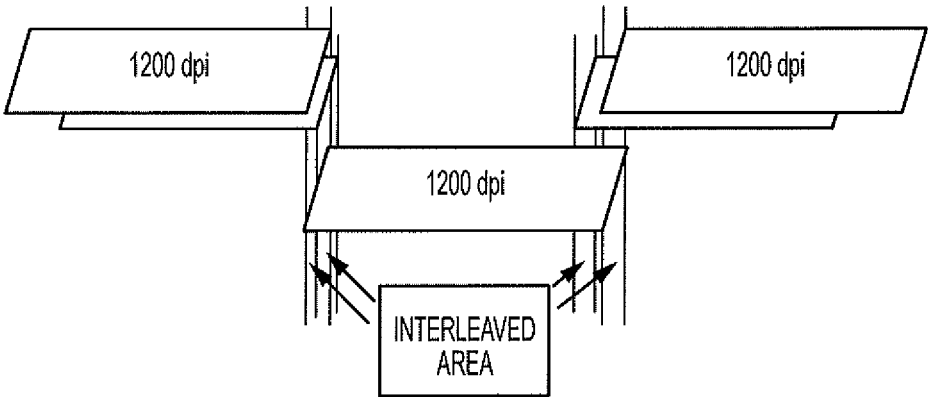
FIG. 5 depicts an interleaved arrangement of printheads in the print zone of the printer shown in FIG. 6.

The printheads in each set of marking stations 322A-322B, 324A-324B, 326A-326B and 328A-328B are arranged in interleaved and staggered arrays to enable printing over the entire cross-process width of a media sheet. For example, marking station 322A includes one array of printheads that print images at a resolution of 600-1200 drops per inch (DPI) in the cross-process direction over a media sheet. Each printhead in the array covers a portion of the width of the media sheet. Marking station 322B includes a second staggered array of printheads that are interleaved with the printheads in the marking station 322A to enable both of the marking stations to print magenta ink across the entire width of the media with a resolution of 600 DPI in the cross-process direction. This arrangement is depicted in FIG. 5

In the print zone 320, the printheads in each marking station eject liquid drops of a phase change ink. In one embodiment, the ink is supplied as a series of solid ink sticks to each of the marking stations 322A-328B. A heater positioned in each marking station melts the ink to supply liquefied ink to the corresponding printhead array. As depicted in FIG. 6, each marking station includes a set of supporting electronics 323. The electronics 323 include driver electronics, which generate the signals that operate the printheads in the marking station 322A. The printheads are also supplied with ink from a supply. In one alternative configuration, two marking stations that print a single color of ink receive melted solid ink from a single supply. In another alternative configuration, the phase change ink is supplied in a plurality of granular pastilles rather than in the form of ink sticks. While printer 300 is depicted as using a phase-change ink, the methods described herein can also be used in xerographic printers using oiled fuser systems, to offset printers using oiled offset systems, and to inkjet printers using alternative forms of ink including aqueous, gel, solvent based, and UV curable inks.

A media sheet moves through the print zone 320 to receive an ink image and the media path 312 moves the media sheet out of the print zone 320 in the process direction. The printheads in marking stations 322A-328B print ink drops onto a predetermined area of the surface of the media sheet as the media sheet moves through the print zone to form an ink image on the media sheet. A section of the media path 312 located after the print zone 320 includes one or more conveyors 314. The conveyors 314 are configured to control the velocity of the media sheet in the process direction as the media sheet approaches a nip 334 formed between spreader roller 332 and pressure roller 336 and to shift the media sheet in the cross-process direction. As described in more detail below, the printer 300 controls the rotation of the rollers 332 and 336 and the movement of media sheets on the conveyors 314 to enable each media sheet to pass through the nip 334 with minimal re-transfer of release agent to a non-imaged side of the media sheet during duplex print operations.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, data, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed in this document. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented in this document are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. The reader should appreciate that a variety of programming languages may be used to implement the teachings of the exemplary embodiment as described in this document.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A printing system comprising:

a plurality of printheads configured to emit discrete units of marking material;

a media transport configured to move media through the printing apparatus past the plurality of printheads to receive the discrete units of marking material;

a first roller configured to follow the movement of the media transport;

a second roller configured to drive the movement of the media transport;

an actuator operatively connected to the second roller and configured to rotate the second roller to drive the movement of the media transport;

a first encoder operatively connected to the first roller and configured to generate a series of tics that identify an index position on the first roller and an angular displacement on the first roller past the index position;

a second encoder operatively connected to the second roller and configured to generate a series of tics that identify an index position on the second roller and an angular displacement on the second roller past the index position;

a clock configured to generate a periodic signal at a predetermined frequency;

a dot clock signal generator operatively connected to one of the printheads in the plurality of printheads and configured to generate a dot clock signal to operate ejectors in the printhead to which the dot clock signal generator is operatively connected; and a controller operatively connected to the first encoder, the second encoder, and the clock, the controller being configured to:

receive the tics from the first encoder and operate the actuator to maintain the movement of the media transport at a predetermined constant velocity;

generate a number of tics corresponding to a distance between a location on a substrate moving in a process direction toward the plurality of printheads and the printhead to which the dot clock signal generator is operatively connected, the generated number of tics having a discrete number of tics and a fractional number of tics;

count the tics generated by the second encoder until the counted number of tics equals the discrete number of tics in the generated number of tics;

count transitions in the periodic signal from the clock until a number of counted transitions equals the fractional number of tics; and operating the dot clock signal generator to generate the signal that activates the ejectors in the printhead operatively connected to the dot clock signal generator when the number of counted transitions equals the fractional number of tics.

2. The printing system of claim 1 wherein the first roller is positioned at a location that remains within a predetermined temperature range.

3. The printing system of claim 2 wherein the predetermined temperature range is from about 20 C.° to about 30 C°.

4. The printing system of claim 3 wherein the first roller has a low coefficient of thermal expansion.

5. The printing system of claim 3 wherein the low coefficient of thermal expansion is within a range of about 20 microns/K° to about 25 microns/K°.

6. The printing system of claim 5 wherein the first roller has a low runout.

7. The printing system of claim 5 wherein the low runout is within a range of about 1 micron to about 20 microns.

8. The printing system of claim 7 wherein the media transport has a degree of wrap with the first roller that is within a predetermined wrap angle range.

9. The printing system of claim 7 wherein the predetermined wrap angle range is about 25 degrees to about 80 degrees.

10. The printing system of claim 9 wherein the second roller is positioned at a location near the plurality of printheads.

11. The printing system of claim 9 wherein the second roller has a slip resistant coating.

12. The printing system of claim 11 wherein the slip resistant coating is one of rubber, polyurethane polyester, and polyether polyester.

13. The printing system of claim 1, the controller being further configured to:

average a number of clock transitions between tics past the index position on the second roller to identify a relative distance between tics around the second roller.

14. The printing system of claim 13, the controller being further configured to:

generate a table of tic distance versus position of the tics generated by the second encoder past the index location of the second roller and a corrected distance per tic.

15. The printing system of claim 14, the controller being further configured to:

count the tics generated by the second encoder using the corrected distance per tic.

16. A method for operating a printing system comprising:

receiving with a controller tics that are generated by a first encoder operatively connected to a first roller of a media transport, the tics identifying an index position on the first roller and an angular displacement on the first roller past the index position;

operating an actuator operatively connected to a second roller of the media transport to maintain movement of the media transport at a predetermined constant velocity;

generating with the controller a number of tics corresponding to a distance between a location on a substrate moving in a process direction toward a plurality of printheads and a printhead to which a dot clock signal generator is operatively connected, the generated number of tics having a discrete number of tics and a fractional number of tics;

counting with the controller tics that are generated by a second encoder operatively connected to the second roller until the counted number of tics generated by the second encoder equals the discrete number of tics in the generated number of tics, the tics generated by the second encoder identifying an index position on the second roller and an angular displacement on the second roller past the index position;

counting with the controller transitions in a periodic signal from a clock until a number of counted transitions equals the fractional number of the generated tics; and operating the dot clock signal generator to generate a dot clock signal that activates ejectors in the printhead operatively connected to the dot clock signal generator when the number of counted transitions equals the fractional number of the generated tics.

17. The method of claim 16 further comprising:

averaging with the controller a number of transitions of the periodic signal from the clock between tics generated by the second encoder past the index position on the second roller to identify a relative distance between tics generated by the second encoder around the second roller.

18. The method of claim 17 further comprising:

generating a table of tic distance versus position of a tic generated by the second encoder past the index location of the second roller and a corrected distance per tic generated by the second encoder.

19. The method of claim 18 further comprising:

counting the tics generated by the second encoder using the corrected distance per tic.

* * * * *